United States Patent [19]

Feustel et al.

[11] 4,402,186

[45] Sep. 6, 1983

[54] STIRLING HEATING PUMP

[75] Inventors: Helmut Feustel, Bielefeld; Rainer Moeres, Gütersloh-Friedrichsdorf, both of Fed. Rep. of Germany

[73] Assignee: Gartemann & Hollmann GmbH, Bielefeld, Fed. Rep. of Germany

[21] Appl. No.: 275,232

[22] Filed: Jun. 19, 1981

[30] Foreign Application Priority Data

Jun. 25, 1980 [DE] Fed. Rep. of Germany ..... 3023660

[51] Int. Cl.[3] ..... F25B 9/00

[52] U.S. Cl. ..... 62/6; 60/520; 74/18.2; 92/34; 92/168; 277/212 FB

[58] Field of Search ..... 62/6; 60/520; 92/34, 92/168; 277/212 FB; 74/18.2

[56] References Cited

U.S. PATENT DOCUMENTS 3,014,500 12/1961 McGowen, Jr. ..... 74/18.2

3,530,681 9/1970 Dehne ..... 62/6

3,626,770 12/1971 Lindberg et al. ..... 74/18.2

4,268,042 5/1981 Borlan ..... 277/212 FB

*Primary Examiner*—Ronald C. Capossela

*Attorney, Agent, or Firm*—Michael J. Striker

[57] ABSTRACT

A Stirling heating pump has a working piston acting upon a compression chamber and actuated by a crank drive accommodated in a housing, and a diaphragm bellows surrounding the working piston for sealing the compression chamber from the housing and having an inner hollow communicating with the former. Pressure variations in the interior of the diaphragm bellows are compensated by a pressure throttling element arranged between the compression chamber and the inner hollow of the diaphragm bellows, and a compensating diaphragm expansible in the housing and having an inner hollow communicating with the inner hollow of the diaphragm bellows serves to form a closed flow circuit.

6 Claims, 1 Drawing Figure

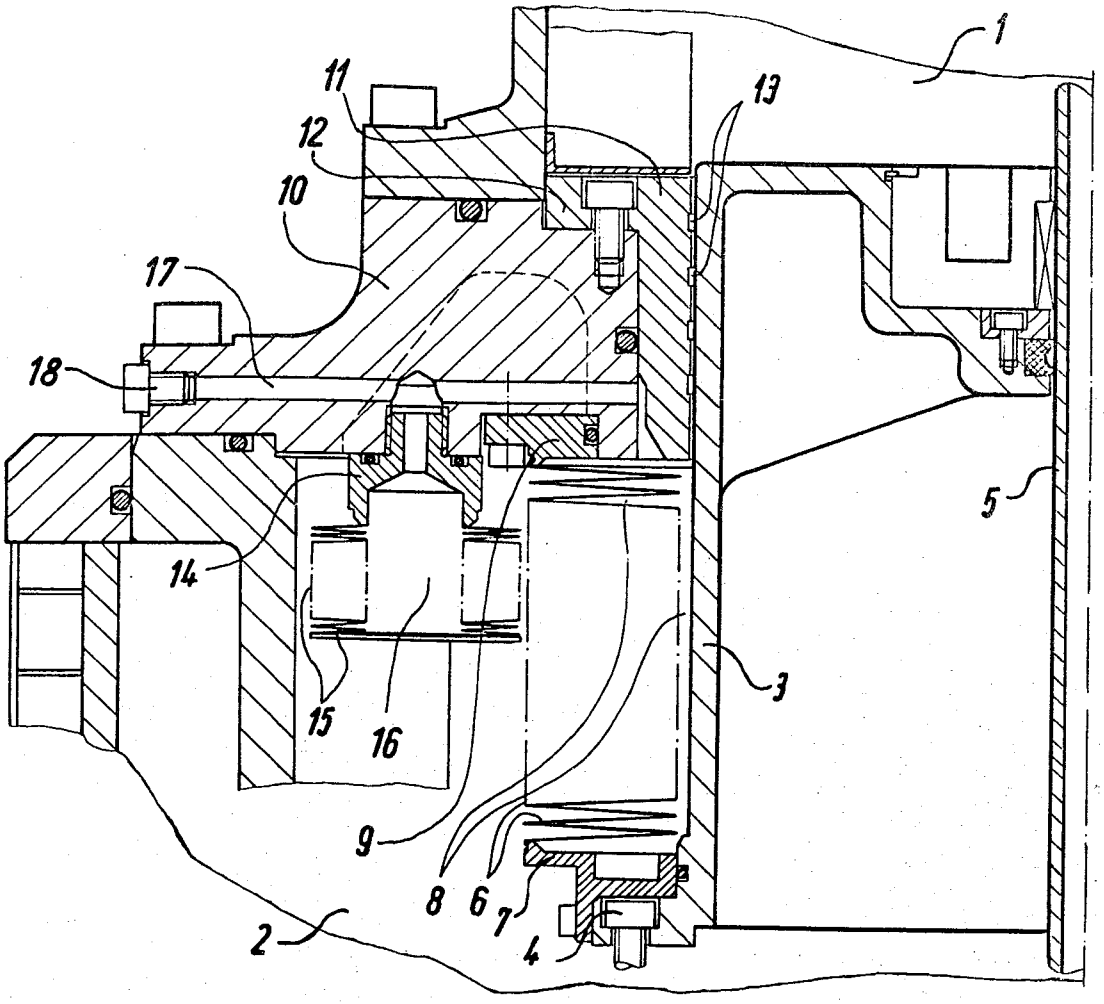
1
5
13
3
11
12
10
17
18
14
15
16
9
8
6
7
4
2

STIRLING HEATING PUMP

BACKGROUND OF THE INVENTION

The present invention relates to a Stirling heating pump.

Stirling heating pumps are known in the art. A known Stirling heating pump has a working piston which is driven by a crank drive and acts upon a compression chamber with which a first heat exchanger, a regenerator formed as the heat accumulator, and a second heat exchanger are connected, whereas an expansion chamber is provided thereabove, and a cam-controlled displacement piston acts upon the expansion chamber. Both pistons displace during the operation practically one gas volume between the compression chamber and the expansion chamber in cyclical controlled manner back and forth. The compression work produced in gas in the compression chamber is taken off in the first heat exchanger as a heat. During displacement of the constantly held gas volume in the cold expansion chamber, the gas flows through the regenerator and gives out the heat remaining in the gas. Thereby the expansion of the gas in the expansion chamber takes place, so that the heat from the surrounding atmosphere can be supplied via the second heat exchanger to the gas. After this, the gas with constant volume is displaced back into the compression chamber. The heat supplied previously into the regenerator is taken off again by the gas. The heat energy given out from such a Stirling heating pump thereby combines the energy recovered from the surrounding atmosphere and the compression energy.

The above described Stirling heating pump operates cyclically in the compression chamber in the pressure region of approximately between 5 and 22 bar. There is a problem to seal the compression chamber from the closed housing for accommodating the crank drive. Generally, the compression chamber is located above the working piston, and the closed crank drive housing is located below the working piston. It is known to provide a diaphragm bellows for sealing a working piston. The diaphragm bellows has the important advantage that it practically has no friction losses and reliably prevents a possible oil fog from flowing from the crank drive housing to the compression chamber in all cases, also in the event of capillary penetration. This is very important inasmuch as the oil fog can after a certain time lead to oil dirtying in the region of the heat exchanger and the regenerator.

Even though these diaphragm bellows provide for the above mentioned advantages, it also causes the problem that the diaphragm bellows performing its intended functions has an insufficient service life. It must be taken into consideration that in the closed crank drive housing a certain pressure, for example an average working pressure of 12.5 bar takes place. Thereby in the working region of 5–22 bar in the compression chamber, the diaphragm bellows is loaded cyclically with a pressure difference of between +10 bar and −7 bar. On the other hand, the replacement of the diaphragm bellows by a normal piston sealing on the working piston is disadvantageous in the sense of a completely reliable sealing of the oil fog from the crank drive housing and in the sense of the friction losses connected therewith.

SUMMARY OF THE INVENTION

Accordingly, it is an object of the present invention to provide a Stirling heating pump which avoids the disadvantages of the prior art.

More particularly, it is an object of the present invention to provide a Stirling heating pump with a diaphragm bellows which, despite the heavy working conditions, has a high service life and provides for a reliable sealing between the compression chamber and the closed crank drive housing of the pump.

In keeping with these objects, and with others which will become apparent hereinafter, one feature of the present invention resides, briefly stated, in a Stirling heating pump, in which a diaphragm bellows surrounding a working piston for sealing a compression chamber from a crank drive housing is provided with means for compensating pressure deviations in the diaphragm bellows. The compensating means is formed as a pressure throttling element arranged between the compression chamber and the inner hollow of the diaphragm bellows, and a compensating diaphragm expansible in the housing and having an inner hollow which communicates with the inner hollow of the diaphragm bellows so as to form a closed flow circuit.

When the Stirling heating pump is designed in accordance with the present invention, first of all, the pressure throttling element protects the inner hollow of the diaphragm bellows surrounding the working piston from high pressure variations which systematically take place in the compression chamber. By selection of a corresponding pressure throttling element, it can be taken care that in any event leakage loss can be received there. With this protection, however, continuous compression and expansion of the volume inside the diaphragm bellows systematically takes place, so that alternating pressure loading occurs, even though to a smaller extent. In accordance with a further feature, the compensation of this pressure difference is performed by the compensating diaphragm, which has an inner hollow communicating with the inner hollow of the diaphragm bellows to form a closed flow circuit and expands in the crank housing. When the diaphragm bellows is compressed, the compensating membrane automatically stretches against the pressure of the closed crank drive housing until the desired pressure compensation with the crank drive housing pressure is attained. Since this compensation step is performed naturally extremely fast, the diaphragm bellows is practically not loaded with a pressure difference, and therefore has a very high service life.

In accordance with another advantageous feature of the present invention, the closed flow circuit is provided with a filling opening so that a pressure medium can be supplied thereinto, and a flow circuit between the inner hollow of the diaphragm bellows and the compensation diaphragm can be formed in a simple way. In an inoperative condition of the heating pump there is practically no pressure difference. Formation of a pressure differential when the crank drive housing and the above mentioned closed flow circuit are simultaneously filled is also prevented during the filling step.

In accordance with a further advantageous feature of the present invention, the pressure throttling element is formed as a gap sealing surrounding the working piston. The gap sealing strictly performs the functions of a normal piston sealing. However, it works in the above mentioned working condition longer and is satisfactorily friction-free, which is very important. Eventual leakage losses from the compression chamber are harmless, inasmuch as the absolutely reliable sealing is performed by the diaphragm bellows.

In accordance with still a further advantageous feature of the present invention, the compensation diaphragm is formed as a signaller.

For example, an end switch can be arranged in an upper and lower end position of the compensation diaphragm. Reaching of the upper end position means that the pressure in the closed flow circuit is too low, for example corresponding to damage to the diaphragm bellows. Reaching of the lower end position means that there is a too high pressure in the closed flow circuit, for example because of high leakage losses from the compression chamber or because of untightness of the crank drive housing.

The novel features which are considered characteristic for the invention are set forth in particular in the appended claims. The invention itself, however, both as to its construction and its method of operation, together with additional objects and advantages thereof, will be best understood from the following description of preferred embodiments when read in connection with the accompanying drawing.

BRIEF DESCRIPTION OF THE DRAWING

The single FIGURE of the drawing shows a Stirling heating pump only in a portion of a closed crank drive housing and a compression chamber.

DESCRIPTION OF THE PREFERRED EMBODIMENT

A Stirling heating pump in accordance with the present invention is shown in the drawing, wherein a left part is illustrated which is symmetrical to a right part thereof. The pump has a compression chamber 1 located above, and a closed crank drive housing 2 located below under the compression chamber 1. The pump has a working piston 3 which is open downwardly toward the crank drive housing 2 and connected by screws 4 with a not shown crank drive accommodated in the housing 2. The working piston 3 operates upwardly upon the compression chamber 1.

Two heat exchangers, a regenerator, an expansion chamber, and a displacement piston are arranged in a conventional manner above the compression chamber 1. A guide pipe 5 for the displacement piston extends downwardly through the working piston 3 until it is guided in the crank drive housing 2 and supported in the latter.

The compression chamber 1 is sealed from the closed crank drive housing 2 with the aid of a diaphragm bellows 6 which surrounds only the lower part of the working piston 3. The diaphragm bellows 6 is mounted by its lower end via a flange 7 in a sealing manner on the working piston 3. An inner hollow 8 of the diaphragm bellows is limited by the inner walls of the material folds of the bellows, on the one hand, and by the outer surface of the working piston 3, on the other hand.

The inner hollow of the diaphragm bellows 6 is closed from below by the flange 7. It is closed from above by a mounting ring 9 with which the diaphragm bellows 6 is connected with a flange piece 10, and also by a section of the flange piece 10 and a cylindrical bush 11. The cylindrical bush 11 is mounted via a flange 12 on the flange piece 10 and arranged on the working piston 3. A pressure throttling element formed as a gap sealing 13 is located between the inner wall of the bush 11 and serves for sealing between the compression chamber 1 and the inner hollow 8 of the diaphragm bellows 6. The gap sealing 13 extends between the compression chamber 11 and the diaphragm bellows 6.

A compensating diaphragm 15 is further provided. The upper end of the compensating diaphragm 15 is mounted on the lower surface of the flange piece 10 in a mounting socket 14. The compensating diaphragm 15 can freely stretch downwardly in the closed crank drive housing 2. The compensating diaphragm has an inner hollow 16 which communicates with a filling passage 17 in the flange piece 10 via a respective opening in the mounting socket 14. The filling passage 17 has a closable inlet opening 18 and communicates with the inner hollow 8 of the diaphragm bellows 6 via an outer recess in the cylindrical bush 11. The inner hollow 8 of the diaphragm bellows forms with the inner hollow 16 of the compensating diaphragm 15, via the respective section of the filling passage 17, a closed flow circuit.

The flow circuit is adjusted to a predetermined pressure via the inlet opening 18 in an inoperative condition of the heating pump. This pressure is equal to the pressure which takes place in the closed crank drive housing 2. For preventing the action of pressure differences upon the diaphragm bellows 6 during the filling step, the filling and adjustment of the pressure are performed simultaneously.

During the operation of the Stirling heating pump, the pressure in the compression chamber 1 varies cyclically, for example between 5 bar and 22 bar. These pressure variations are held remote from the inner hollow 8 of the diaphragm bellows by the gap sealing 13 which operates in friction-free manner. During the working cycle of the working piston 3, a cyclical compression and expansion of the inner hollow 8 of the diaphragm bellows takes place. However, an immediate pressure compensation to the pressure in the crank drive housing 2 takes place, inasmuch as during the compression of the inner hollow 8 of the diaphragm bellows 6 the compensating diaphragm 15 stretches automatically against the pressure in the crank drive housing 2 until the pressure compensation is attained. Thereby, the action of pressure differences upon the diaphragm bellows 6 is reliably prevented.

The compensating diaphragm 15 is advantageously formed as a signaller. For example, a not shown end switch can be arranged in a predetermined upper end position as well as in a predetermined lower end position of the compensating diaphragm 15. When during the operation of the Stirling heating pump the compensating diaphragm 15 reaches its upper end position, this shows that too low a pressure in the closed flow circuit of the inner hollows 8 and 16 exists, which can occur because of an untightness of the diaphragm bellows 6. When the compensating diaphragm reaches during the operation of the heating pump its lower end position, this means that too high a pressure exists in the closed flow circuit, for example because of too high leakage losses from the compression chamber 1 through the gap sealing 13 or because an untightness of the crank drive housing exists.

It will be understood that each of the elements described above, or two or more together, may also find a useful application in other types of constructions differing from the types described above.

While the invention has been illustrated and described as embodied in a Stirling heating pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A drive unit of a Stirling heating pump having a compression chamber and a working piston acting upon said compression chamber, the drive unit comprising a crank drive actuating said working piston; a closed housing for accommodating said crank drive; a diaphragm bellows arranged in said closed housing and surrounding said working piston for sealing said compression chamber from said housing, said diaphragm bellows having an inner hollow communicating with said compression chamber; a pressure throttling element arranged between said compression chamber and said inner hollow of said diaphragm bellows for protecting said inner hollow of said diaphragm bellows from relatively high pressure variations in said compression chamber, while allowing relatively low pressure variations in said inner hollow of said diaphragm bellows; and means for compensating the pressure variations in said diaphragm bellows and including a compensating diaphragm expansible also in said closed housing and having an inner hollow communicating with said inner hollow of said diaphragm bellows so as to form a closed flow circuit.

2. A Stirling heating pump as defined in claim 1, wherein said diaphragm bellows of said working piston extends in an upright direction, said pressure throttling element having a gap sealing arranged above said diaphragm bellows and cylindrically surrounding said working piston.

3. A Stirling heating pump as defined in claim 1, and further comprising means forming a filling passage which communicates with said inner hollow of said diaphragm bellows and said inner hollow of said compensating diaphragm, so as to communicate with said closed flow circuit.

4. A Stirling heating pump as defined in claim 3, wherein said filling passage is provided with a closable filling opening and means for closing the latter.

5. A Stirling heating pump as defined in claim 1, wherein said compensating diaphragm is formed as a signalling element.

6. A Stirling heating pump as defined in claim 5, wherein said compensating diaphragm has an upper end position and a lower end position; and further comprising an end switch arranged in said end positions of said compensating diaphragm and actuated by the latter.

* * * * *